US011830425B2

(12) United States Patent
Wall et al.

(10) Patent No.: US 11,830,425 B2
(45) Date of Patent: Nov. 28, 2023

(54) MODIFYING PIXEL USAGE

(71) Applicant: Google LLC, Mountain View, CA (US)

(72) Inventors: Marissa Karen Wall, Mountain View, CA (US); Christine L. Franks, San Jose, CA (US); Seang Yong Chau, Los Altos, CA (US); Glen Murphy, Mountain View, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/752,697

(22) Filed: May 24, 2022

(65) Prior Publication Data

US 2022/0293056 A1 Sep. 15, 2022

Related U.S. Application Data

(63) Continuation of application No. 16/768,973, filed as application No. PCT/US2018/064943 on Dec. 11, 2018, now Pat. No. 11,355,062.

(60) Provisional application No. 62/689,540, filed on Jun. 25, 2018, provisional application No. 62/599,294, filed on Dec. 15, 2017.

(51) Int. Cl.

| | |
|---|---|
| ***G09G 3/3208*** | (2016.01) |
| ***G09G 3/3233*** | (2016.01) |
| ***G09G 3/20*** | (2006.01) |
| *G09G 3/30* | (2006.01) |

(52) U.S. Cl.

CPC ..... *G09G 3/3233* (2013.01); *G09G 3/2003* (2013.01); *G09G 3/2074* (2013.01); *G09G 3/3208* (2013.01); *G09G 3/30* (2013.01); *G09G 2300/0452* (2013.01); *G09G 2320/0233* (2013.01)

(58) Field of Classification Search

CPC .. G09G 3/3233; G09G 3/2003; G09G 3/2074; G09G 2300/0452; G09G 2320/0233; G09G 2320/0285; G09G 2320/0295; G09G 2320/048; G09G 3/30; G09G 3/3208; G09G 3/20

See application file for complete search history.

(56) References Cited

U.S. PATENT DOCUMENTS

| | | | | |
|---|---|---|---|---|
| 2007/0146385 | A1 | 6/2007 | Kienhöefer | |
| 2008/0177994 | A1* | 7/2008 | Mayer | G06F 16/00 709/224 |
| 2008/0180354 | A1 | 7/2008 | Kienhöefer | |

(Continued)

FOREIGN PATENT DOCUMENTS

| | | | | |
|---|---|---|---|---|
| JP | 09091253 | A * | 4/1997 | G06F 1/32 |

*Primary Examiner* — Adam R. Giesy

(74) *Attorney, Agent, or Firm* — McDonnell Boehnen Hulbert & Berghoff LLP

(57) ABSTRACT

In general, the subject matter described in this disclosure can be embodied in methods, systems, and program products for modifying usage of display device pixels. A computing system monitors usage of a plurality of pixels of a display device and determines a target usage level. The computing system identifies that a usage level of a first pixel does not satisfy the target usage level and selects an occasion at which to present the first pixel in a frame to be presented by the display device with an increased intensity with respect to an original intensity that was specified for the first pixel by the frame. The computing system activates the first pixel at the increased intensity during presentation by the display device of the frame.

20 Claims, 7 Drawing Sheets

(56) References Cited

U.S. PATENT DOCUMENTS

| | | | | |
|---|---|---|---|---|
| 2010/0103198 | A1* | 4/2010 | Polak | G09G 3/30 345/690 |
| 2011/0090200 | A1 | 4/2011 | Choi et al. | |
| 2012/0242712 | A1 | 9/2012 | Ko et al. | |
| 2016/0063923 | A1 | 3/2016 | Yang et al. | |
| 2018/0286356 | A1 | 10/2018 | Jiang et al. | |

* cited by examiner

MODIFYING PIXEL USAGE

CROSS-REFERENCE TO RELATED DISCLOSURES

This application is a continuation of U.S. patent application Ser. No. 16/768,973, filed on Jun. 2, 2020, which is a national stage application under 35 U.S.C. § 371 of International Application No. PCT/US2018/064943, filed on Dec. 11, 2018, which claims priority to U.S. Provisional Patent Application No. 62/689,540, filed on Jun. 25, 2018, and which claims priority to U.S. Provisional Patent Application No. 62/599,294, filed on Dec. 15, 2017, each of which are incorporated herein by reference in their entirety.

TECHNICAL FIELD

This document generally relates to modifying pixel usage.

BACKGROUND

Many modern computing devices include display devices to present graphical content, such as videos and the content of web pages. These displays typically comprise thousands or even millions of individual pixels. In some types of displays, each pixel has a corresponding electronic component (e.g., a diode) that generates light when activated with electricity. The amount or quality of light generated by the electronic component may change over time with sustained use of the electronic component.

SUMMARY

This document describes techniques, methods, systems, and other mechanisms for modifying pixel usage. In some examples, a computing system such as a smartphone computing device monitors the usage of pixels in a display device, for example by analyzing each frame or occasionally-presented frames. The computing system may identify that certain pixels are not used as often or in the same way as other pixels (e.g., because the pixels render darker colors and therefore output with less intensity), and may increase or alter usage of such less-commonly used pixels, for example, by turning the less-commonly used pixels on when they otherwise would have been off, or by activating the less-commonly used pixels at intensities that are greater than intensities initially specified to produce graphical content designated for presentation by the display. Increasing usage of the less-often used pixels may limit differential aging that can occur among pixels of certain types of displays (an issue sometimes called display ghosting or burn-in).

Embodiment 1 is a computer-implemented method to modify usage of display device pixels. The method includes monitoring, by a computing system, usage of a plurality of pixels of a display device. The method includes determining, by the computing system based on analysis of the usage of the plurality of pixels, a target usage level. The method includes identifying, by the computing system, that a first usage level of a first pixel of the plurality of pixels does not satisfy the target usage level. The method includes selecting, by the computing system in response to having identified that the first usage level of the first pixel does not satisfy the target usage level, an occasion at which to present the first pixel in a frame to be presented by the display device with an increased intensity with respect to an original intensity that was specified for the first pixel by the frame. The method includes activating, by the computing system, the first pixel at the increased intensity during presentation by the display device of the frame.

Embodiment 2 is the method of embodiment 1, wherein the display device comprises an organic light-emitting diode display device.

Embodiment 3 is the method of embodiment 1 or 2, wherein monitoring the usage of the plurality of pixels of the display device includes monitoring an activated intensity of each pixel in the plurality of pixels at each of a plurality of times.

Embodiment 4 is the method of any preceding embodiment. Monitoring the usage of the plurality of pixels of the display device includes estimating the usage of the plurality of pixels based on (i) information that identifies a length at which each of multiple application programs had focus on the display device, and (ii) information that identifies intensity of the plurality of pixels in user interfaces of the multiple application programs.

Embodiment 5 is the method of embodiment 4, wherein: (i) the information that identifies the length at which each of the multiple application programs had focus includes times at which each of the multiple application programs gained focus or lost focus on the display device; and (ii) the information that identifies the intensity of the plurality of pixels in the user interfaces of the multiple application programs includes screenshots of the user interfaces of the multiple application programs.

Embodiment 6 is the method of any preceding embodiment, wherein determining the target usage level includes selecting multiple pixels from the plurality of pixels that have greatest usage levels among the plurality of pixels and using the usage levels for the multiple pixels that have the greatest usage levels to determine the target usage level.

Embodiment 7 is the method of any preceding embodiment, wherein determining the target usage level includes selecting multiple pixels in proximity to the first pixel and using the usage levels for the multiple pixels in proximity to the first pixel to determine the target usage level.

Embodiment 8 is the method of any preceding embodiment. Monitoring the usage of the plurality of pixels of the display device includes reducing, by the computing system, a common level of usage from all pixels in the plurality of pixels responsive to determining that all pixels in the plurality of pixels have at least the common level of usage.

Embodiment 9 is the method of any preceding embodiment wherein selecting the occasion at which to present the first pixel in the frame with the increased intensity includes identifying that a device in which the display device is housed has connected with an external power source.

Embodiment 10 is the method of any preceding embodiment, wherein selecting the occasion at which to present the first pixel in the frame with the increased intensity includes identifying that the display device is in an off state.

Embodiment 11 is the method of any preceding embodiment, wherein selecting the occasion at which to present the first pixel in the frame with the increased intensity includes identifying that a proximity sensor in a device in which the display device is housed has detected that an object is proximate the proximity sensor.

Embodiment 12 is the method of any preceding embodiment, wherein the computing system activates the first pixel at the increased intensity during presentation by the display device of the frame concurrent with the computing system activating a majority of pixels of the display device at original intensities that were specified for the respective pixels by the frame.

Embodiment 13 is the method of any preceding embodiment. The method further comprises identifying, by the computing system, that a usage level for each pixel in a subset of pixels from among the plurality of pixels is less than the target usage level or other corresponding target usage levels, with the first pixel being one of the pixels in the subset of pixels. The method further comprises activating, by the computing system as part of the presentation by the display device of the frame, each pixel in the subset of pixels at a corresponding increased intensity that is greater than an original intensity that is specified for the respective pixel by the frame.

Embodiment 14 is directed to one or more computer-readable devices having instructions stored thereon, that when executed by one or more processors, cause the performance of actions according to the method of any one of embodiments 1 through 13.

Embodiment 15 is directed to a computerized system that includes one or more processors and one or more computer-readable devices including instructions that, when executed by the one or more processors, cause the computerized system to perform the method of any one of embodiments 1 through 13.

Particular implementations can, in certain instances, realize one or more of the following advantages. Reducing differential aging of pixels of a display device may increase the accuracy of images produced by the display. Reducing differential aging of pixels may also increase the useful lifespan of the display.

Reducing differential aging of pixels after a device has been provided to a user may limit or eliminate the need to activate displays at manufacturing facilities for extended periods of time to initially age pixels in the display. This reduction or elimination of the need to age displays during the manufacturing process can increase the speed at which displays can be created, can reduce or eliminate the amount of physical space needed in manufacturing facilities to produce displays, can reduce the amount of electricity needed to manufacture displays, and may ultimately lower the expense of producing displays.

Differential aging can be addressed by increasing the level of electricity (e.g., increasing voltage or current) to an electrical component corresponding to a pixel that has aged more than other electrical components, in order to increase the brightness of that electrical component and compensate for its reduced light output. Providing increased levels of electricity to an electrical component that has already aged more than an average, however, further ages that electrical component. Mechanisms described in this disclosure can avoid unduly activating electrical components that have already aged more than other electrical components in a display device. The mechanisms described herein may achieve this in a manner which does not overly negatively impact the levels of power available to the device from its onboard power storage (e.g., the device's battery). The mechanisms described herein may further achieve this without negatively impacting the usability of the display by a user.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

This document generally describes modifying pixel usage. A computing device may modify pixel usage by identifying certain pixels that are used less often than other pixels, and increasing an intensity at which those less-often used pixels are activated with respect to originally-intended intensities. Because pixels decrease in brightness with use over time in some types of displays, increasing or otherwise altering the use of less-often used pixels reduces differential aging among pixels of a display device and therefore increases the accuracy of images produced by the display device.

Figure 1B:
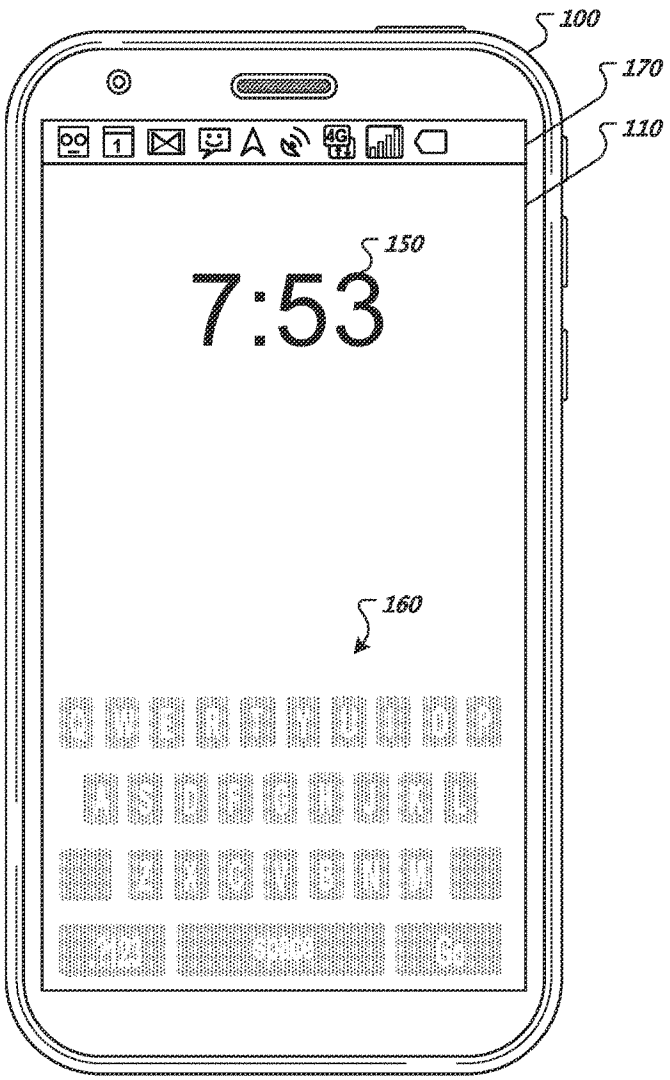
FIGS. 1A-B illustrate a display device that has experienced differential aging.
Figure 1A:
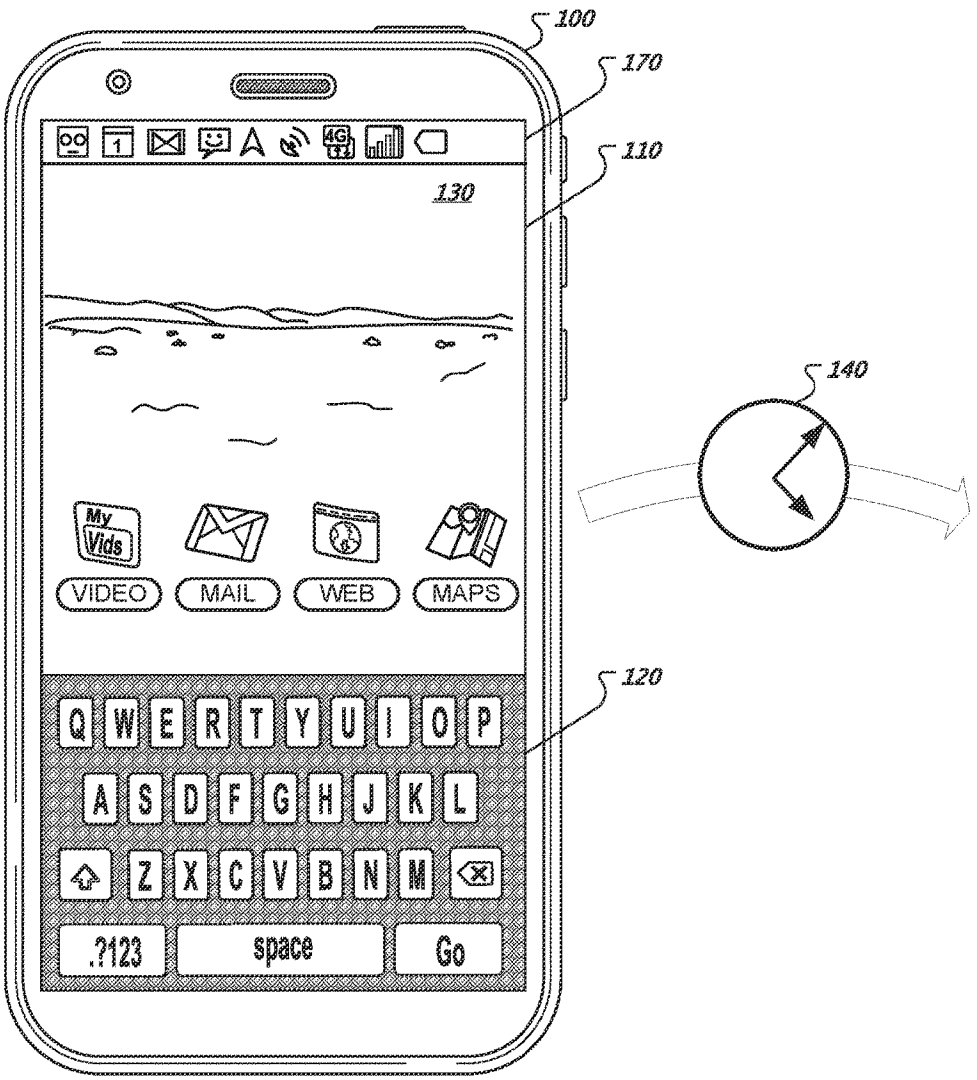

FIGS. 1A-B illustrate a display device that has experienced differential aging. The figures show a device 100 in different states, with FIG. 1A showing device 100 in a state in which a keyboard is displayed, and FIG. 1B showing device 100 in a different state in which the keyboard is not displayed. These illustrations show how graphical objects that are presented at the same location on a display for significant amounts of time may cause pixels to age at different rates, potentially resulting in inaccurate production of images, as illustrated by the "burnt in" keyboard 160 that is shown in FIG. 1B.

FIG. 1A shows device 100 as a smartphone, but device 100 could also be another type of electronic device that includes a display, such as a tablet computer, a laptop computer, a desktop computer, a thermostat, or a watch, to name a few examples. Device 100 includes a display 110, which is an OLED display in this example. Display 110 could be other types of displays, such as those that experience differential aging among display components that generate or manipulate light for the display.

Display 110 in FIG. 1A depicts two main content regions, a keyboard region 120 and a main content display region 130. Device 100 may display a keyboard in the keyboard region 120 a substantial amount of time that display 110 is active, and the keyboard presented in that region 120 may appear the same all or much of that time. As such, the pixels that comprise the region 120 of the display at which the keyboard is presented may repeatedly be activated according to a particular pattern that produces the display of the keyboard.

The display of the keyboard in the keyboard region 120 includes multiple graphical keyboard keys that each include a light-colored background with a dark-shaded graphic therein (e.g., a character or symbol). The background of the keyboard that surrounds and serves as a backdrop to the keys is a dark-shaded color. As such, to display the keyboard, device 100 activates the pixels that generate the light-colored background of the keys while not activating or only marginally activating the pixels that correspond to the locations of either the graphic in each key or the background that surrounds and serves as a backdrop to the keys. This results in the pixels that correspond to the light-colored background of each key seeing substantially more usage than other pixels within keyboard region 120. It will be appreciated that, as explained below, this dark-shaded/light-colored pixel scenario is not specific to the keyboard example outlined above but is generally applicable to a range of possible example situations at the display.

As mentioned previously, pixels in some types of displays effectively dim over time with usage. As such, should a computing device regularly activate a first block of pixels and rarely activate an adjacent, second block of pixels, subsequent activation of both blocks of pixels with the same intended intensity may result in the first block of pixels producing less light and appearing dimmer than the second block of pixels.

This phenomenon is sometimes referred to as differential aging of components in a display device. A visual example of differential aging is illustrated in FIG. 1B, which shows the display 110 after device 100 has displayed the keyboard 120 for a substantial period of time 140 (e.g., a few dozen hours). In FIG. 1B, device 110 is attempting to display a clock time 150 with a substantially-uniform, light-colored background covering the remainder of the display 110. The result, however, is that the region 160 at which the keyboard was displayed for a substantial period of time 140 does not present the substantially-uniform, light-colored background that was designated for that region by electronics of device 100. Rather, there is a disparity among the light output by different pixels within that region due to some pixels having aged more than others. Specifically, those pixels that presented the light-colored background for the keyboard keys aged more. The result is inaccurate image production (e.g., "ghosting" of previously displayed images).

It should be noted that FIGS. 1A-B illustrate both an exaggerated and simplified example of differential aging for purposes of illustration herein. A keyboard was selected for this illustration as the graphical object that produced differential aging due to its size, but devices often hide software keyboards during use and therefore infrequent display of a keyboard may not cause significant differential aging as illustrated in FIG. 1B (or at least the degree to which differential aging is exhibited in FIG. 1B). Differential aging is more likely to occur with objects that are persistently, or substantially persistently, displayed at a same location and that are not often removed from display, such as graphical objects presented as fundamental operating system features, like navigation buttons or status bar icons. Although FIGS. 1A-B show navigation bar icons 170 at the top of display 110, icons 170 are shown in both device states in this example and therefore differential aging would be less apparent to a user of device 100.

Further, it should be noted that differential aging could appear in the main body 130 of the display, but such aging is not illustrated in FIG. 1B for purposes of simplicity. Still, should device 100 present the clock time 150 for substantial periods of time (e.g., for 8 hours each night while a user sleeps), differential aging may result among pixels that present the clock time 150 and its surrounding background, especially those pixels that are always activated in the clock (e.g., the ":" separating hours and minutes). Any such "ghosting" of the clock time 150 that may appear on another display screen would be due to the pixels that generate the clock time 150 not being used as much as the surrounding region of the display.

Figure 2:
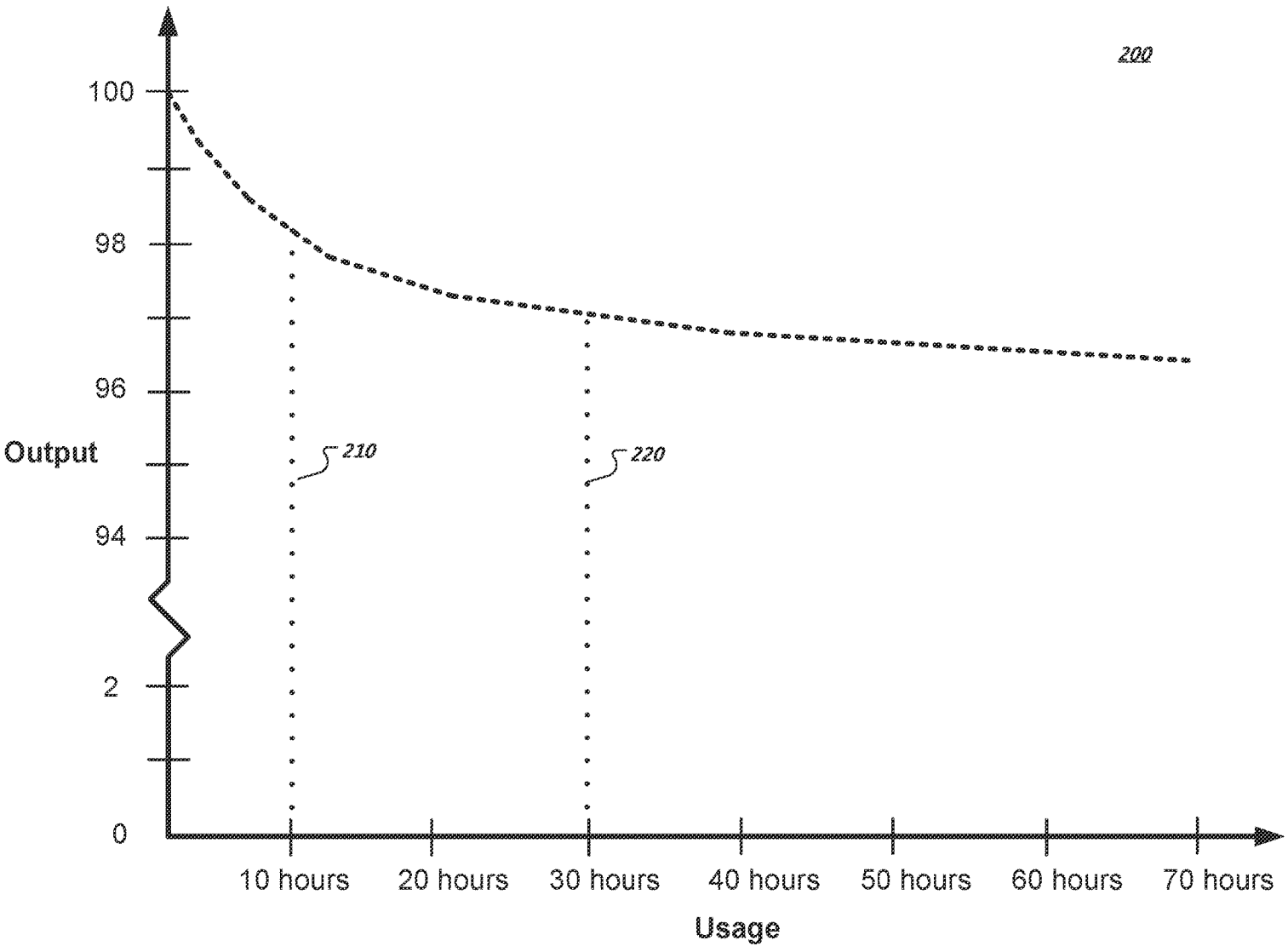
FIG. 2 shows a graph that illustrates an electrical component of a display device aging with extended use.

FIG. 2 shows a graph that illustrates an electrical component of a display device aging with extended use. The electrical component may be a component diode of an OLED display, and graph 200 shows how the maximum output of the diode may decrease over time with use of the diode.

In some displays, each pixel comprises multiple component pixels, with each pixel producing a different color with a corresponding electrical component (e.g., one diode for a red sub-pixel, one diode for a green sub-pixel, and one diode for a blue sub-pixel, with other color schemes being possible). As described previously in this disclosure, each of these pixels/diodes may age with use, and the aging process may involve the diode outputting less light for a given electrical input (e.g., less nits of brightness for a given current, voltage, or current and voltage). Graph 200 illustrates this aging process, with the output of a diode as a percentage of initial output decreasing with usage.

As graph 200 illustrates, the reduction in light output is logarithmic, with the reduction being steep at the beginning and tapering off over time. For example, graph 200 illustrates that the light output after 10 hours of usage has declined to roughly 98% its original value (see item 210), which represents a decrease of 2% over the first 10 hours of usage. Another subsequent decrease of only 1%, however, takes another 20 hours of usage (see item 220), which is twice as long to produce half the same decrease in brightness. Although not shown, after 600 hours of usage, the light output may have only decreased a total of 5%, to 95% of the initial output of the electrical component.

The usage values in FIG. 2 are illustrated as hours for illustrative purposes, but actual usage may be more complex due to varying activation levels. As an example, the usage values illustrated in FIG. 2 may represent usage of the electrical component when fully activated. In real-world use as part of a display, the electrical component may be activated partially at times. As such, partial activation (e.g., 33% activation) of an electrical component for 10 hours may not see the same 2% decline in brightness that is illustrated in FIG. 2. Rather, the same decline in brightness may take longer amount of time (e.g., 20 hours, 30 hours, or 40 hours). The pixel usage described herein (e.g., the usage of the electrical component that generates light for the pixel) may account for not only time of activation but also level/intensity of activation.

Figure 3A:
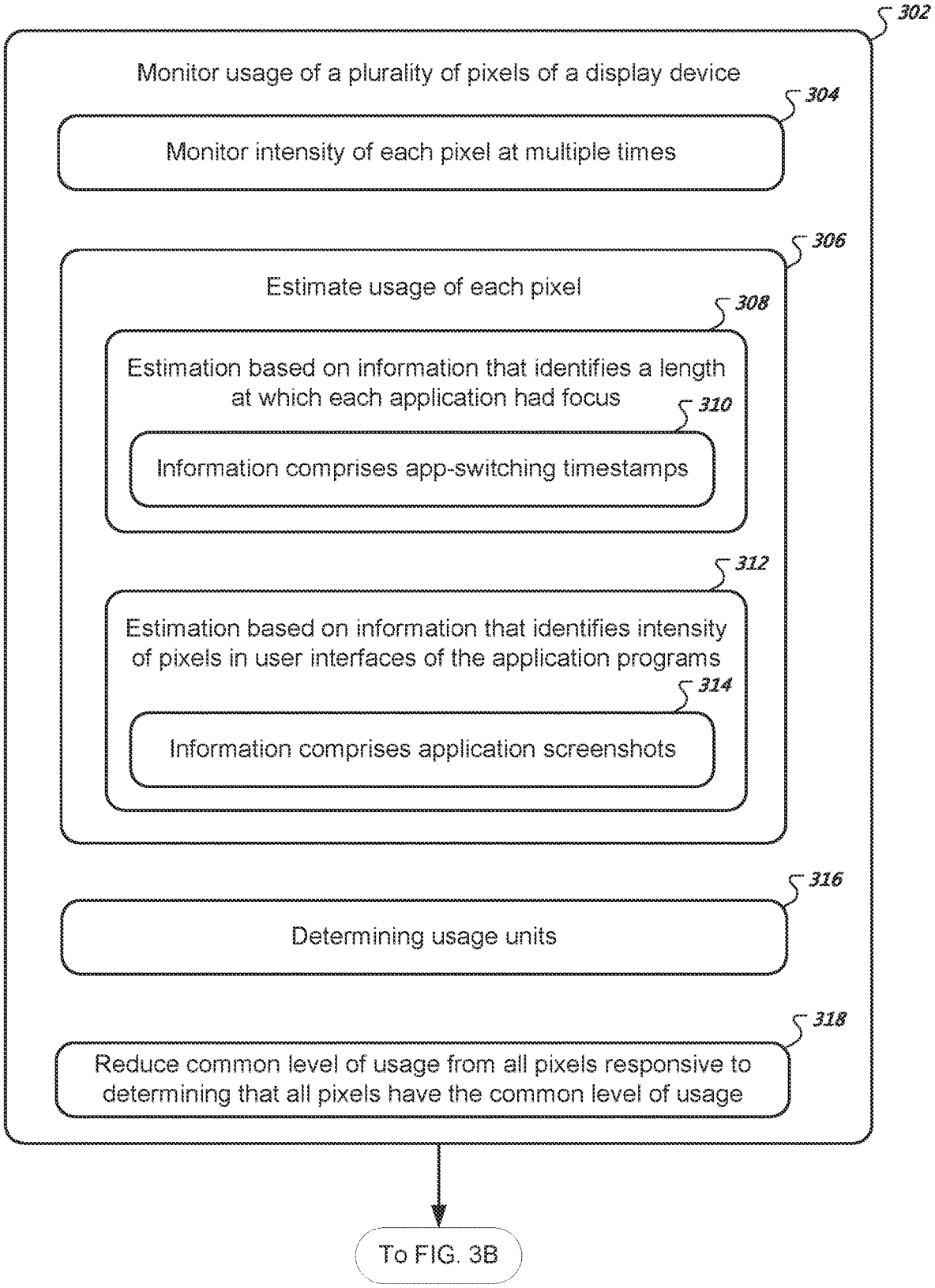
FIGS. 3A-C show a flowchart of a process for limiting differential aging among electrical components of a display device.
Figure 3B:
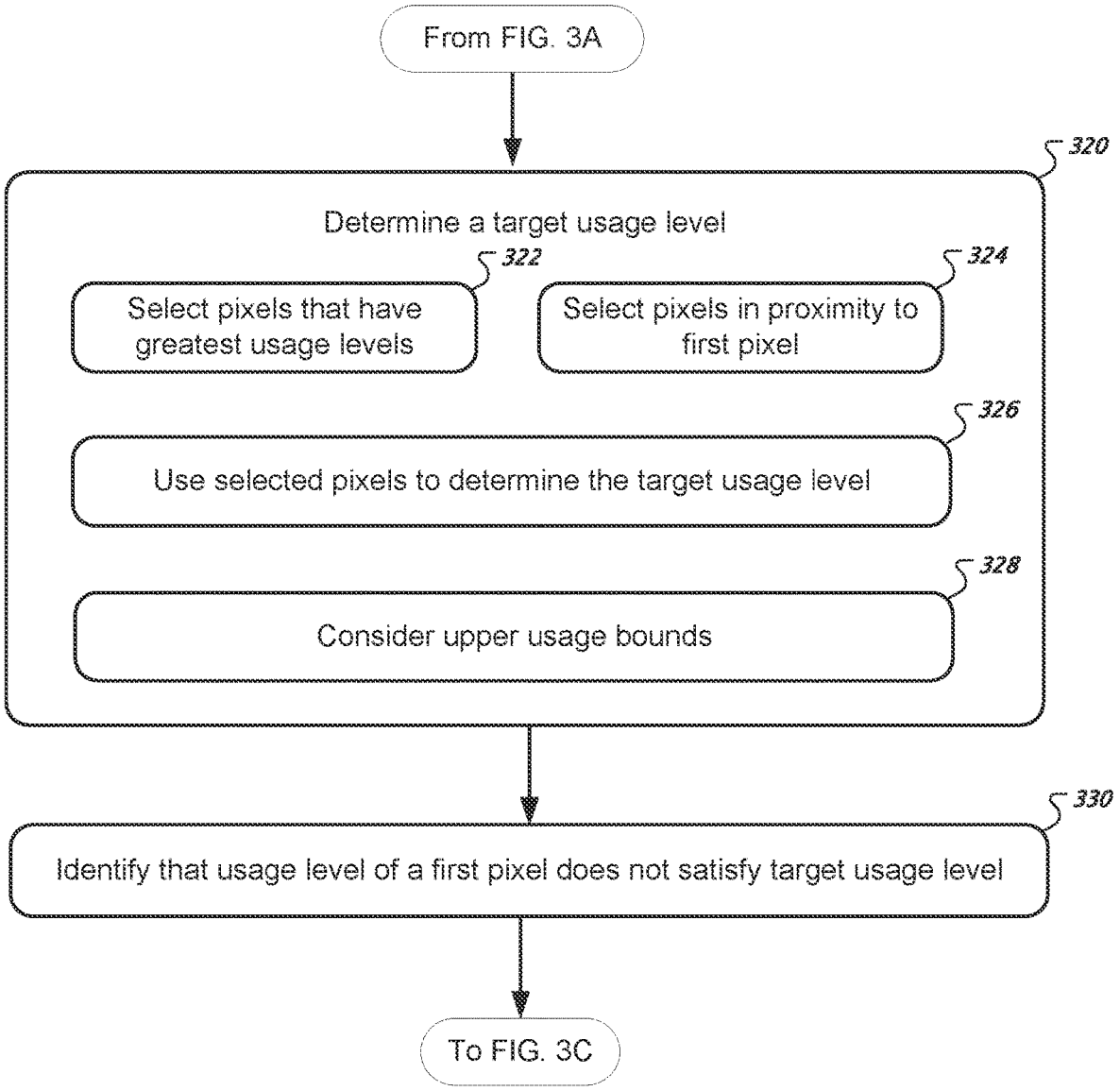
Figure 3C:
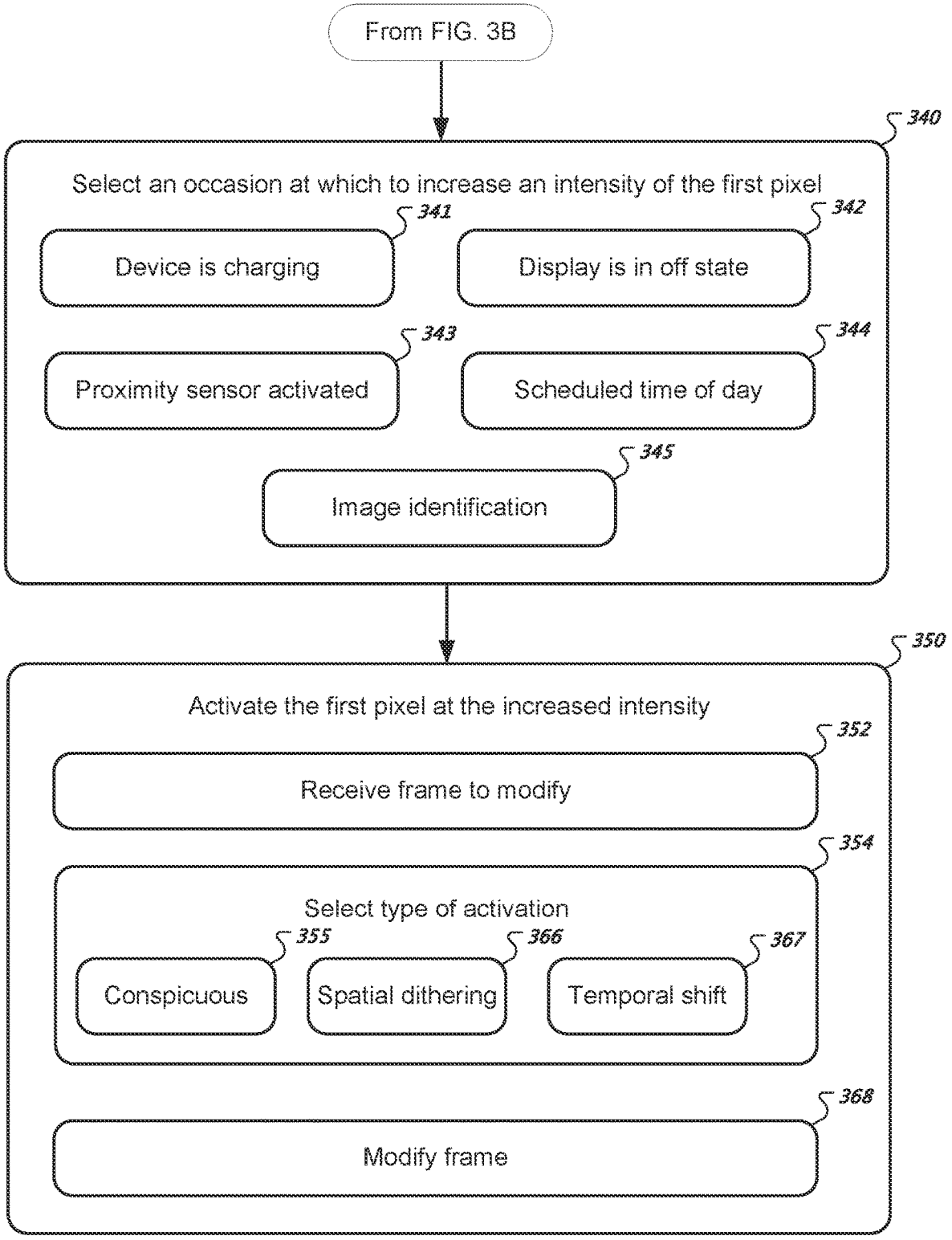

FIGS. 3A-B show a flowchart of a process for limiting differential aging among electrical components of a display device. This process describes additional and/or alternative aspects of mechanisms already described in this disclosure.

At box 302, a computing system monitors usage of a plurality of pixels of a display device. For example, computing device 100 of FIG. 1 may monitor how often each pixel in display 110 is activated (e.g., a total duration of operation), and an intensity of each activation. Each pixel referenced in this disclosure may be a sub-pixel that produces a particular color that makes up a pixel with other sub-pixels, and monitoring activation of the sub-pixel may involve monitoring activation of the corresponding electrical component that generates light for the sub-pixel. Monitoring usage can involve estimating usage of the pixel, for example, as described below.

The plurality of pixels that the computing system monitors may only be a subset of pixels of the display. For instance, the computing system may select to only monitor usage of pixels at a particular region of the display 110, for example, the keyboard region 120 that is illustrated in FIG. 1. The selected region or subset of pixels may be predesignated by a developer of an operating system or of the computing system, based on knowledge that one or more regions of the display will present the same graphical objects substantial amounts of time. An effect of monitoring only a subset of pixels on the display is that the computing system may perform the process described herein with respect to only that subset of pixels.

At box 304, the computing system monitors usage of the pixels by monitoring the operating intensity of each pixel at multiple different times. For example, the computing system may monitor the intensity of each pixel at each frame presented by the display (e.g., the intensity of each pixel at each screen refresh, which may occur each 1/60th of a second). Analyzing pixel usage at each frame, however, may require more processing and power usage than is necessary. As such, the computing system may identify the intensity of each pixel at intervals that span multiple frames, for example, every 60 frames (every 1 second).

At box 306, the computing system monitors the usage of the plurality of pixels by estimating the usage of each pixel. The estimation may be based on information that identifies a length at which each application program had focus (box 308) and information that identifies an intensity of pixels in respective user interfaces of those application programs (box 312). In general, the computing system may access information that identifies which applications have had focus and control of what is presented on the display and for how long. The information that identifies a length for which each application had focus can include timestamps that identify when the user interfaces of applications gained focus on the display device or lost focus on the display device (box 310). For instance, a user may provide input to switch from a first application program to a second application program, and the computing system may store a timestamp that indicates when the computing system stopped displaying the first application program and started displaying the second application program.

The computing system can determine what each application program presents on the display at the location of the monitored pixels in various manners. In a first manner, the computing system takes a screenshot of the application program when the application program loses focus (box 314) (where the computing system may not otherwise take such screenshots). The computing system can analyze that screenshot to determine what the application program is presenting at a location of the monitored pixels. In another example, the computing system may have access to information that indicates what each application program presents at a location of the pixels (e.g., a developer of the operating system may create a data store of such information).

In some examples, the computing system monitors not only which application programs have had focus and for how long, and what those application programs presented at certain locations, but the computing system may also monitor an overall brightness level of the display, whether the display was in a night mode in which blue tints are reduced, and whether the computing system is in an accessibility mode in which the content or color of objects presented by the display may be different. The computing system may use such information to determine usage levels of the pixels.

At box 316, pixel monitoring involves determining pixel usage units. For example, each subpixel can have a value of "reversal units" attached to that subpixel, which represents unmitigated pixel usage. A reversal unit for a sub-pixel can be calculated by the amount of color the subpixel was emitting multiplied by the brightness, over a duration of one second. For example, a pure-red pixel at full brightness for one second may create a reversal unit of "1." There are various manners in which to monitor pixel usage, and assigning "reversal units" to pixels is only one such mechanism.

At box 318, as part of the monitoring process, the computing system may reduce a common level of usage from all pixels (e.g., the monitored subset of pixels) responsive to determining that all such pixels have the common level of usage. In effect, the usage levels for pixels may be pruned. For example, if all pixels on a display exhibit at least a given level of usage (e.g., at least 20 reversal units of usage, such that all pixels have a usage level between 20 reversal units and 57 reversal units), the usage level of all pixels can be reduced by that given level of usage (e.g., all pixels can be reduced 20 reversal units, such that all pixels now have a usage level between 0 reversal units and 37 reversal units).

At box 320, the computing system determines a target usage level based on analysis of the usage of the plurality of pixels.

At box 322, the determination of the target usage level may involve a selection of one or more pixels that have the greatest usage levels. The pixels that have the greatest usage levels may be those pixels that are activated with the greatest intensity the most often. In the illustration of FIGS. 1A-B, these would be the pixels that correspond to the light-colored background within each key in the keyboard region 120 of FIG. 1A. Selecting the target usage level as the greatest usage level may cause the computing system to activate pixels that do not have that same high level of usage in an effort to "catch up" the rest of the pixels to the age of the one or more pixels that have been used the most.

At box 324, the computing system determines a target usage level based on a selection and analysis of pixels that are in proximity to a particular pixel. For example, the device 100 may look to localized regions to identify pixels that have locally high usage. Thus, the target usage level for pixels in different portions of the display may differ. As such, even should there be a pixel near the top of the display with extra-high usage, the target usage level for pixels at the bottom of the display may be based on usage of surrounding pixels and may differ from a target usage level for pixels at the top of the display.

At box 326, the computing system uses the selected pixels to determine a target usage level for a particular pixel or a group of pixels. There are multiple different ways to use pixels to determine a target usage level, some of which have already been mentioned in this disclosure. One example mechanism is to identify one or more pixels with the greatest usage levels, either globally across the display or in localized regions, and activate other pixels to attempt to even out pixel usage. Another example mechanism is to set a target usage level that is a threshold percentage of the highest usage across the entire display or in the relevant localized region. For example, the target usage level could be set to 90% that of the highest used pixel (or 90% of the average usage level of the top 1000 most-used pixels). The computing system would therefore attempt to drive usage levels of other pixels to that 90% level. The computing system may select the 90% level (or some other proportion of the highest usage level) rather than the 100% level, to limit over-manipulation of pixels and because the difference between 90% and 100% usage may not be visible to a user.

At box 328, the computing system considers an upper bounds in determining the target usage level. For example, and as described with respect to FIG. 2, the decrease in light output may level out after substantial usage of display components. As such, there may be benefits to stopping, or at least tapering out, attempts to equalize pixel usage after pixels have reached a certain level of usage. Accordingly, the system may set a maximum target usage level (e.g., 600 hours of full intensity use). After pixels reach this maximum target usage level, the computing system may no longer activate such pixels in a pixel-equalization process, even if other pixels have seen significantly more usage (e.g., 900 hours). In some examples, the upper usage bounds may account for the difference between pixel usage. For example, after 600 hours of usage, the system may not equalize a particular pixel unless the target usage level is 50% higher than current usage of a pixel. Alternatively, the target usage level as a percentage of the most-used pixels can decrease with usage (e.g., the target usage level may decrease to 70% of the average usage level of the top 1000 most-used pixels from an initial value of 90% after that average usage level reaches several hundred hours).

At box 330, the computing system identifies that a first usage level of a first pixel of the plurality of pixels does not satisfy the target usage level. For example, the computing system may identify that a pixel has been used less than the target usage level. The computing system may perform this identification for multiple pixels, effectively identifying those pixels that are candidates for additional activation in a pixel equalization process.

At box 340, the computing system selects an occasion at which to increase an intensity of the first pixel in a frame to be displayed by the display device, over an original intensity that was specified for the first pixel in the frame. For example, the computing system may identify that the computing system has reached a state in which it is appropriate to increase the intensity of pixels that have not aged as much as other pixels. As described throughout this disclosure, increasing the intensity of the pixels in a pixel equalization process can include turning the pixels on when they otherwise would have been off, or increasing a brightness of the pixels over levels at which the pixels would otherwise be displayed, in distinction to other pixels in the display that are displayed at their originally-intended brightness levels.

At box 341, the computing system determines that it is charging (e.g., the device is connected to an external power source), and as a result requests implementation of the pixel equalization process. The computing system may implement the pixel equalization process when it is charging because the user may be less likely to be using the device (and therefore less likely to notice any changes in pixel activation) and because the additional power consumption required to activate additional pixels would not drain the battery.

At box 342, the computing system determines that its display is in an off state, and as a result requests implementation of the pixel equalization process. The computing system may implement the pixel equalization process when the display is in the off state because display accuracy may not be a priority when the display is in an off state. An off state may not require that the entire display be off, and may be a state to which the device defaults after a long period of non-use or after a user presses button associated with turning off the display. For instance, some pixels may remain activated during the off state to display the time and date, but the majority of pixels of the display may remain unactivated (e.g., more than 50%, 60%, 70%, 80%, or 90% of the pixels may remain unactivated).

At box 343, the computing system determines that a proximity sensor of the computing system is activated, and as a result requests implementation of the pixel equalization process. Proximity sensor activation in certain computing systems, such as smartphones, may correspond to states in which the smartphone is face down on a surface, is in a pocket, or is in a bag. In such states, the display may not be visible to a user and display accuracy may not be a priority.

At box 344, the computing system determines that a current time corresponds to a scheduled time of day, and as a result requests implementation of the pixel equalization process. The schedule time of day may be a time of day at which a user does not often use the phone, such as night time, and therefore may be a preferred time at which to perform a pixel equalization process.

At box 345, the computing system identifies that an image presented by the display is suitable for implementation of the pixel equalization process, and as a result requests implementation of the pixel equalization process, at least at a location at which the image is presented. Example images suitable for implementation of the pixel equalization process may be images that provide notable variance among the pixels that comprise the image, in contrast to an image that presents a single color across a region or all of the display. Images with variance may be suitable for implementation of a pixel equalization process because modest variances in pixel intensity levels over those originally designated for display may not be noticeable to a user.

At box 350, the computing system activates the first pixel at the increased intensity during presentation by the display device of a frame. In short, the computing system may increase an intensity level of pixels that have not aged as much as other pixels, either tuning such pixels at least partially on when they would otherwise be off, or increasing a brightness of such pixels over brightness levels originally specified by a frame. This activation of pixels may be in response to the device 100 requesting that a pixel equalization be performed (e.g., in response to the operations of box 340).

At box 352, the computing system may receive a frame to modify. For example, the computing system may have identified a particular frame for presentation by the display device. That frame may be the content of an image buffer, such as a frame of a video that the computing system is playing and that the computing system is about to present with the display device. The frame may also represent a generally static presentation by the computing system, such as the display of a desktop background and associated operating system graphical elements (see FIG. 1A) or the display of a clock (see FIG. 1B).

At box 354, the computing system selects a type of activation.

At box 365, a first type of activation is to conspicuously activate those pixels that have been designated for activation (e.g., at full intensity) in an effort to equalize pixel usage quickly. Conspicuous pixel activation by definition may be apparent to some users viewing the display, and therefore may be more suitable for occasions in which the device is unlikely to be viewed by a user (e.g., the device is face down on a surface, see box 343). Of course, the computing system may age those pixels designated for activation by increasing their intensity only a modest amount over the intensity level originally designated for presentation by the display device (e.g., a 0.5%, 1%, 3%, 5%, or 10% increase in intensity). Such modest increases in pixel intensity may not be noticeable to some or all users.

At box 366, a second type of activation is to perform a spatial dithering of pixels that have been designated for activation. For example, the computing system may increase the intensity of multiple spatially-separated pixels by 5%, so that the increased intensities are not noticeable to users. As such, the computing system may effectively scatter portions of the display with increases in pixel intensity in a noise pattern, so that the pixel equalization process may not be noticeable to users.

At box 367, a third type of activation is to perform a temporal shift of pixels that have been designated for activation. In such a mechanism, device 100 may activate different pixels with increased intensities at different times so that all pixels subject to the pixel equalization process are not brightened at the same time. As such, temporal shifting may be combined with spatial dithering, so that a seemingly random pattern of pixels output additional light at any given time and that seemingly random pattern of pixels changes from moment to moment (e.g., each frame or collection of frames).

At box 368, once a particular collection of one or more pixels has been identified for activation at an increased intensity, the received frame (see box 352) is modified to increase the brightness level of the identified one or more pixels. For example, the computing system may update the values of certain pixels in an image buffer to have greater intensities. The computing system then presents the modified frame with the display device. Presenting the modified frame instead of the frame that was originally-designated for presentation provides increased usage of pixels that otherwise would not have seen as much usage.

This process of activating pixels that have not seen as much usage, as described at box 352, may continuously repeat until either the state of the computing system changes to one in which pixel equalization is no longer appropriate (e.g., the computing system is unplugged from external power, see box 340), or certain pixels are no longer eligible for pixel equalization because they have reached the target usage level, see box 330). In examples in which the pixel equalization process may occur only when the computing system is plugged into external power, or is otherwise being charged via a physical or wireless power connection to an external power source, the pixel equalization process does not negatively impact the level of charge in the onboard power storage of the device and thereby does not affect the 'battery life' of the onboard storage. A similar situation occurs when the pixel equalization process only occurs when the charge level of the onboard storage is above a certain threshold, regardless of a connection of the computing system to external power. In such scenarios, any impact on the 'battery life' of the onboard energy storage caused by the pixel equalization process is unlikely to affect the general availability and usability of the computing system for other functionality.

In some examples, a presentation may be provided that is optimized to combat differential aging that sometimes results from presentation of commonly-displayed user interface features. For example, a computing system may display a screensaver that activates pixels that surround a "home" button user interface element, so that the difference in usage between those pixels and the pixels that light the "home" button is decreased. The presentation may include a gradient extending outward from the "home" button, which pixels near the location of the "home" button being activated with more intensity and pixels further away from the "home" button being activated with less intensity.

Further to the descriptions above, a user may be provided with controls allowing the user to make an election as to both if and when systems, programs or features described herein may enable collection application usage, corresponding screenshots, and/or pixel usage. In addition, certain data may be treated in one or more ways before it is stored or used, so that personally identifiable information is removed. For example, information identifying usage of an application may be used to identify one of multiple templates used to display a certain portion of the user interface (e.g., one of four ways to display a navigation bar). Upon an application being closed or losing focus, the computing device may update an indication of overall use of the template and information that identifies the specific application may be permanently discarded. Furthermore, any information that identifies usage of particular applications or pixels over time may remain on the computing device in an encrypted form and may not be transmittable to another computing device.

Figure 4:
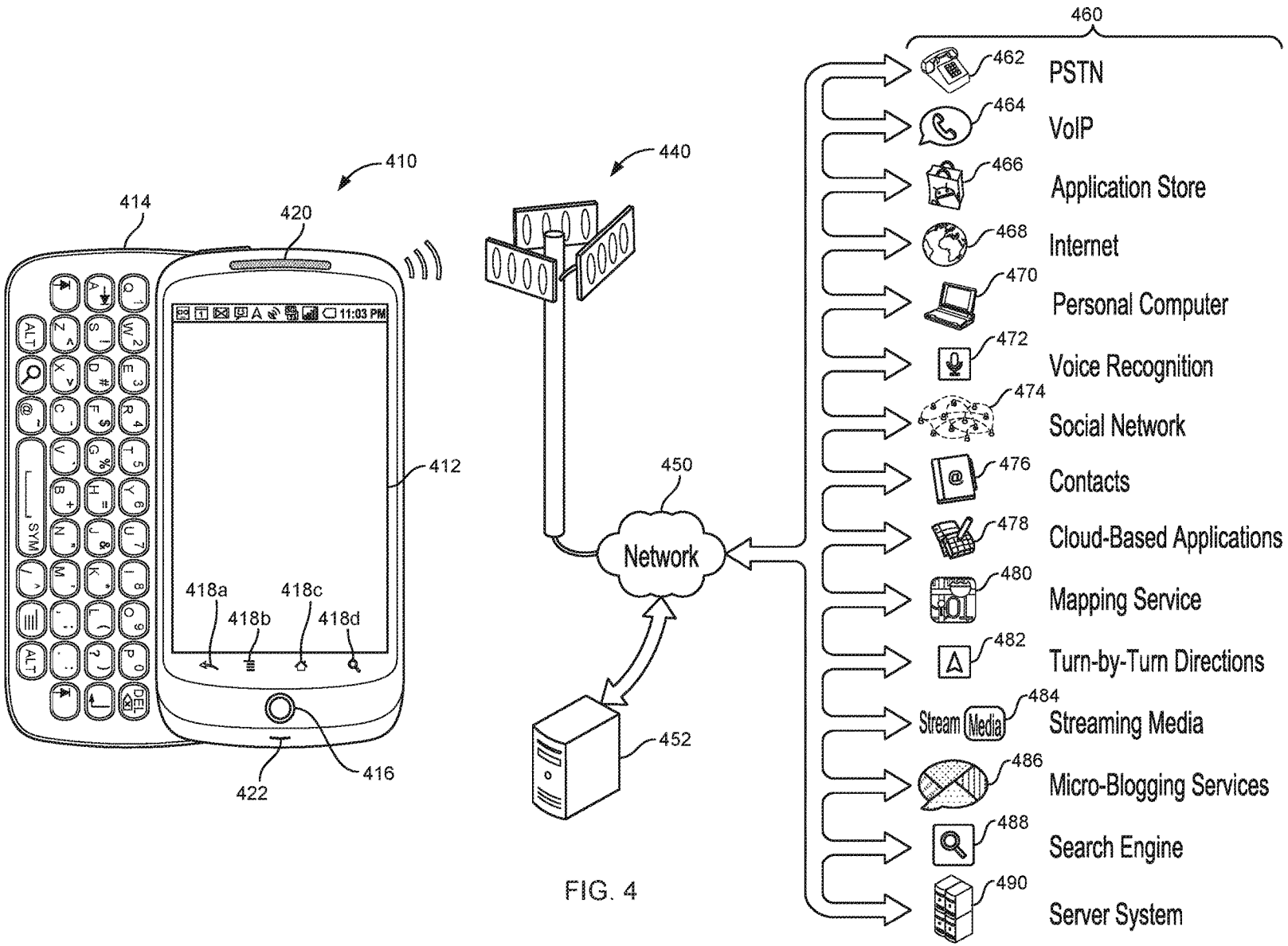
FIG. 4 is a conceptual diagram of a system that may be used to implement the systems and methods described in this document.

Referring now to FIG. 4, a conceptual diagram of a system that may be used to implement the systems and methods described in this document is illustrated. In the system, mobile computing device 410 can wirelessly communicate with base station 440, which can provide the mobile computing device wireless access to numerous hosted services 460 through a network 450.

In this illustration, the mobile computing device 410 is depicted as a handheld mobile telephone (e.g., a smartphone, or an application telephone) that includes a touchscreen display device 412 for presenting content to a user of the mobile computing device 410 and receiving touch-based user inputs. Other visual, tactile, and auditory output components may also be provided (e.g., LED lights, a vibrating mechanism for tactile output, or a speaker for providing tonal, voice-generated, or recorded output), as may various different input components (e.g., keyboard 414, physical buttons, trackballs, accelerometers, gyroscopes, and magnetometers).

Example visual output mechanism in the form of display device 412 may take the form of a display with resistive or capacitive touch capabilities. The display device may be for displaying video, graphics, images, and text, and for coordinating user touch input locations with the location of displayed information so that the device 410 can associate user contact at a location of a displayed item with the item. The mobile computing device 410 may also take alternative forms, including as a laptop computer, a tablet or slate computer, a personal digital assistant, an embedded system (e.g., a car navigation system), a desktop personal computer, or a computerized workstation.

An example mechanism for receiving user-input includes keyboard 414, which may be a full qwerty keyboard or a traditional keypad that includes keys for the digits '0-9', '*', and '#.' The keyboard 414 receives input when a user physically contacts or depresses a keyboard key. User manipulation of a trackball 416 or interaction with a track pad enables the user to supply directional and rate of movement information to the mobile computing device 410 (e.g., to manipulate a position of a cursor on the display device 412).

The mobile computing device 410 may be able to determine a position of physical contact with the touchscreen display device 412 (e.g., a position of contact by a finger or a stylus). Using the touchscreen 412, various "virtual" input mechanisms may be produced, where a user interacts with a graphical user interface element depicted on the touchscreen 412 by contacting the graphical user interface element. An example of a "virtual" input mechanism is a "software keyboard," where a keyboard is displayed on the touchscreen and a user selects keys by pressing a region of the touchscreen 412 that corresponds to each key.

The mobile computing device 410 may include mechanical or touch sensitive buttons 418*a-d*. Additionally, the mobile computing device may include buttons for adjusting volume output by the one or more speakers 420, and a button for turning the mobile computing device on or off. A microphone 422 allows the mobile computing device 410 to convert audible sounds into an electrical signal that may be digitally encoded and stored in computer-readable memory, or transmitted to another computing device. The mobile computing device 410 may also include a digital compass, an accelerometer, proximity sensors, and ambient light sensors.

An operating system may provide an interface between the mobile computing device's hardware (e.g., the input/output mechanisms and a processor executing instructions retrieved from computer-readable medium) and software. Example operating systems include ANDROID, CHROME, IOS, MAC OS X, WINDOWS 7, WINDOWS PHONE 7, SYMBIAN, BLACKBERRY, WEBOS, a variety of UNIX operating systems; or a proprietary operating system for computerized devices. The operating system may provide a platform for the execution of application programs that facilitate interaction between the computing device and a user.

The mobile computing device 410 may present a graphical user interface with the touchscreen 412. A graphical user interface is a collection of one or more graphical interface elements and may be static (e.g., the display appears to remain the same over a period of time), or may be dynamic (e.g., the graphical user interface includes graphical interface elements that animate without user input).

A graphical interface element may be text, lines, shapes, images, or combinations thereof. For example, a graphical interface element may be an icon that is displayed on the desktop and the icon's associated text. In some examples, a graphical interface element is selectable with user-input. For example, a user may select a graphical interface element by pressing a region of the touchscreen that corresponds to a display of the graphical interface element. In some examples, the user may manipulate a trackball to highlight a single graphical interface element as having focus. User-selection of a graphical interface element may invoke a pre-defined action by the mobile computing device. In some examples, selectable graphical interface elements further or alternatively correspond to a button on the keyboard 404. User-selection of the button may invoke the pre-defined action.

In some examples, the operating system provides a "desktop" graphical user interface that is displayed after turning on the mobile computing device 410, after activating the mobile computing device 410 from a sleep state, after "unlocking" the mobile computing device 410, or after receiving user-selection of the "home" button 418*c*. The desktop graphical user interface may display several graphical interface elements that, when selected, invoke corresponding application programs. An invoked application program may present a graphical interface that replaces the desktop graphical user interface until the application program terminates or is hidden from view.

User-input may influence an executing sequence of mobile computing device 410 operations. For example, a single-action user input (e.g., a single tap of the touchscreen, swipe across the touchscreen, contact with a button, or combination of these occurring at a same time) may invoke an operation that changes a display of the user interface. Without the user-input, the user interface may not have changed at a particular time. For example, a multi-touch user input with the touchscreen 412 may invoke a mapping application to "zoom-in" on a location, even though the mapping application may have by default zoomed-in after several seconds.

The desktop graphical interface can also display "widgets." A widget is one or more graphical interface elements that are associated with an application program that is executing, and that display on the desktop content controlled by the executing application program. A widget's application program may launch as the mobile device turns on. Further, a widget may not take focus of the full display. Instead, a widget may only "own" a small portion of the desktop, displaying content and receiving touchscreen user-input within the portion of the desktop.

The mobile computing device 410 may include one or more location-identification mechanisms. A location-identification mechanism may include a collection of hardware and software that provides the operating system and application programs an estimate of the mobile device's geographical position. A location-identification mechanism may employ satellite-based positioning techniques, base station transmitting antenna identification, multiple base station triangulation, internet access point IP location determinations, inferential identification of a user's position based on search engine queries, and user-supplied identification of location (e.g., by receiving user a "check in" to a location).

The mobile computing device 410 may include other applications, computing sub-systems, and hardware. A call handling unit may receive an indication of an incoming telephone call and provide a user the capability to answer the incoming telephone call. A media player may allow a user to listen to music or play movies that are stored in local memory of the mobile computing device 410. The mobile device 410 may include a digital camera sensor, and corresponding image and video capture and editing software. An internet browser may enable the user to view content from a web page by typing in an addresses corresponding to the web page or selecting a link to the web page.

The mobile computing device 410 may include an antenna to wirelessly communicate information with the base station 440. The base station 440 may be one of many base stations in a collection of base stations (e.g., a mobile telephone cellular network) that enables the mobile computing device 410 to maintain communication with a network 450 as the mobile computing device is geographically moved. The computing device 410 may alternatively or additionally communicate with the network 450 through a Wi-Fi router or a wired connection (e.g., ETHERNET, USB, or FIREWIRE). The computing device 410 may also wirelessly communicate with other computing devices using BLUETOOTH protocols, or may employ an ad-hoc wireless network.

A service provider that operates the network of base stations may connect the mobile computing device 410 to the network 450 to enable communication between the mobile computing device 410 and other computing systems that provide services 460. Although the services 460 may be provided over different networks (e.g., the service provider's internal network, the Public Switched Telephone Network, and the Internet), network 450 is illustrated as a single network. The service provider may operate a server system 452 that routes information packets and voice data between the mobile computing device 410 and computing systems associated with the services 460.

The network 450 may connect the mobile computing device 410 to the Public Switched Telephone Network (PSTN) 462 in order to establish voice or fax communication between the mobile computing device 410 and another computing device. For example, the service provider server system 452 may receive an indication from the PSTN 462 of an incoming call for the mobile computing device 410. Conversely, the mobile computing device 410 may send a communication to the service provider server system 452 initiating a telephone call using a telephone number that is associated with a device accessible through the PSTN 462.

The network 450 may connect the mobile computing device 410 with a Voice over Internet Protocol (VoIP) service 464 that routes voice communications over an IP network, as opposed to the PSTN. For example, a user of the mobile computing device 410 may invoke a VoIP application and initiate a call using the program. The service provider server system 452 may forward voice data from the call to a VoIP service, which may route the call over the internet to a corresponding computing device, potentially using the PSTN for a final leg of the connection.

An application store 466 may provide a user of the mobile computing device 410 the ability to browse a list of remotely stored application programs that the user may download over the network 450 and install on the mobile computing device 410. The application store 466 may serve as a repository of applications developed by third-party application developers. An application program that is installed on the mobile computing device 410 may be able to communicate over the network 450 with server systems that are designated for the application program. For example, a VoIP application program may be downloaded from the Application Store 466, enabling the user to communicate with the VoIP service 464.

The mobile computing device 410 may access content on the internet 468 through network 450. For example, a user of the mobile computing device 410 may invoke a web browser application that requests data from remote computing devices that are accessible at designated universal resource locations. In various examples, some of the services 460 are accessible over the internet.

The mobile computing device may communicate with a personal computer 470. For example, the personal computer 470 may be the home computer for a user of the mobile computing device 410. Thus, the user may be able to stream media from his personal computer 470. The user may also view the file structure of his personal computer 470, and transmit selected documents between the computerized devices.

A voice recognition service 472 may receive voice communication data recorded with the mobile computing device's microphone 422, and translate the voice communication into corresponding textual data. In some examples, the translated text is provided to a search engine as a web query, and responsive search engine search results are transmitted to the mobile computing device 410.

The mobile computing device 410 may communicate with a social network 474. The social network may include numerous members, some of which have agreed to be related as acquaintances. Application programs on the mobile computing device 410 may access the social network 474 to retrieve information based on the acquaintances of the user of the mobile computing device. For example, an "address book" application program may retrieve telephone numbers for the user's acquaintances. In various examples, content may be delivered to the mobile computing device 410 based on social network distances from the user to other members in a social network graph of members and connecting relationships. For example, advertisement and news article content may be selected for the user based on a level of interaction with such content by members that are "close" to the user (e.g., members that are "friends" or "friends of friends").

The mobile computing device 410 may access a personal set of contacts 476 through network 450. Each contact may identify an individual and include information about that individual (e.g., a phone number, an email address, and a birthday). Because the set of contacts is hosted remotely to the mobile computing device 410, the user may access and maintain the contacts 476 across several devices as a common set of contacts.

The mobile computing device 410 may access cloud-based application programs 478. Cloud-computing provides application programs (e.g., a word processor or an email program) that are hosted remotely from the mobile computing device 410, and may be accessed by the device 410 using a web browser or a dedicated program. Example cloud-based application programs include GOOGLE DOCS word processor and spreadsheet service, GOOGLE GMAIL webmail service, and PICASA picture manager.

Mapping service 480 can provide the mobile computing device 410 with street maps, route planning information, and satellite images. An example mapping service is GOOGLE MAPS. The mapping service 480 may also receive queries and return location-specific results. For example, the mobile computing device 410 may send an estimated location of the mobile computing device and a user-entered query for "pizza places" to the mapping service 480. The mapping service 480 may return a street map with "markers" superimposed on the map that identify geographical locations of nearby "pizza places."

Turn-by-turn service 482 may provide the mobile computing device 410 with turn-by-turn directions to a user-supplied destination. For example, the turn-by-turn service 482 may stream to device 410 a street-level view of an estimated location of the device, along with data for providing audio commands and superimposing arrows that direct a user of the device 410 to the destination.

Various forms of streaming media 484 may be requested by the mobile computing device 410. For example, computing device 410 may request a stream for a pre-recorded video file, a live television program, or a live radio program. Example services that provide streaming media include YOUTUBE and PANDORA.

A micro-blogging service 486 may receive from the mobile computing device 410 a user-input post that does not identify recipients of the post. The micro-blogging service 486 may disseminate the post to other members of the micro-blogging service 486 that agreed to subscribe to the user.

A search engine 488 may receive user-entered textual or verbal queries from the mobile computing device 410, determine a set of internet-accessible documents that are responsive to the query, and provide to the device 410 information to display a list of search results for the responsive documents. In examples where a verbal query is received, the voice recognition service 472 may translate the received audio into a textual query that is sent to the search engine.

These and other services may be implemented in a server system 490. A server system may be a combination of hardware and software that provides a service or a set of services. For example, a set of physically separate and networked computerized devices may operate together as a logical server system unit to handle the operations necessary to offer a service to hundreds of computing devices. A server system is also referred to herein as a computing system.

In various implementations, operations that are performed "in response to" or "as a consequence of" another operation (e.g., a determination or an identification) are not performed if the prior operation is unsuccessful (e.g., if the determination was not performed). Operations that are performed "automatically" are operations that are performed without user intervention (e.g., intervening user input). Features in this document that are described with conditional language may describe implementations that are optional. In some examples, "transmitting" from a first device to a second device includes the first device placing data into a network for receipt by the second device, but may not include the second device receiving the data. Conversely, "receiving" from a first device may include receiving the data from a network, but may not include the first device transmitting the data.

"Determining" by a computing system can include the computing system requesting that another device perform the determination and supply the results to the computing system. Moreover, "displaying" or "presenting" by a computing system can include the computing system sending data for causing another device to display or present the referenced information.

Figure 5:
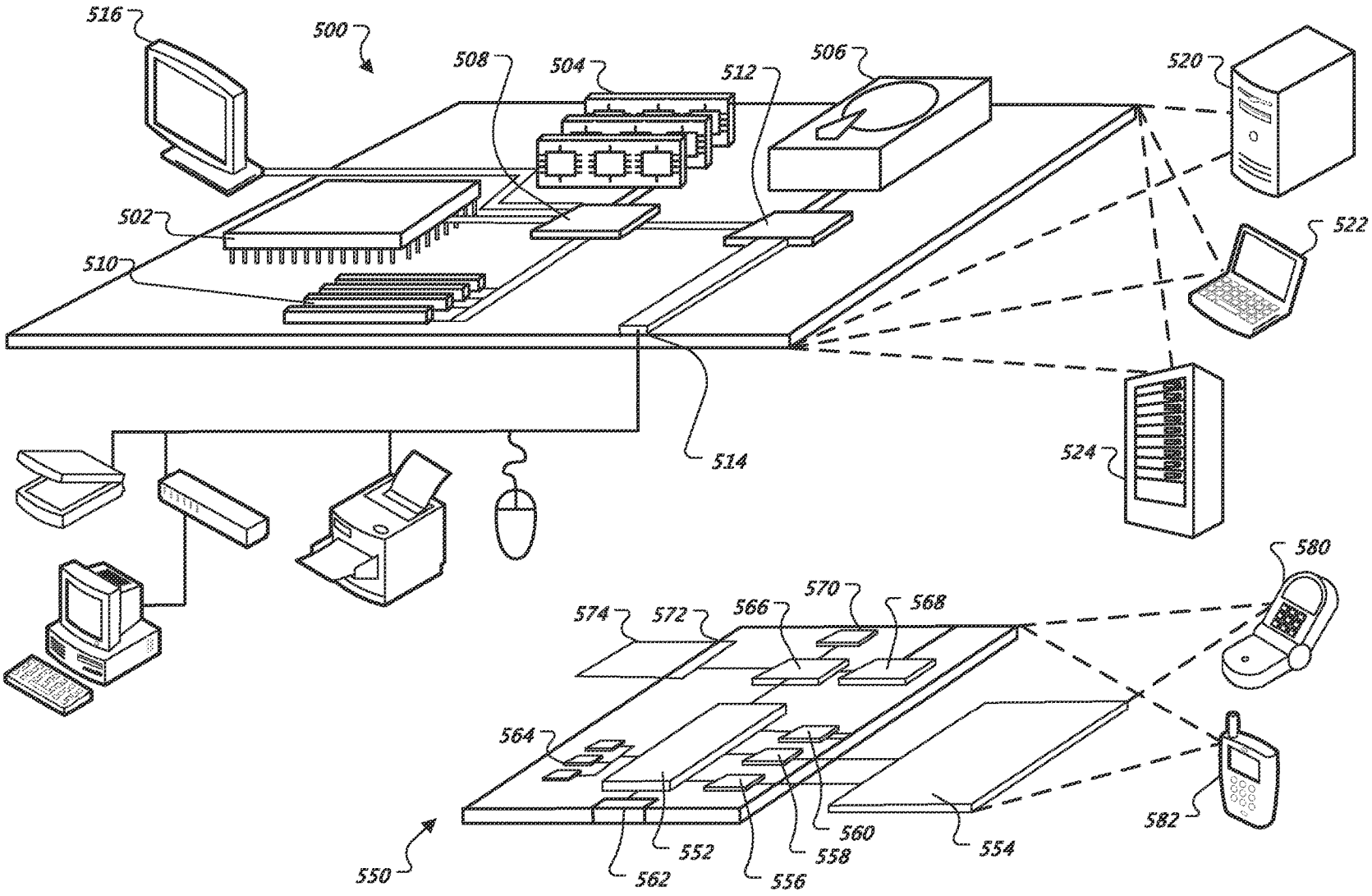
FIG. 5 is a block diagram of computing devices that may be used to implement the systems and methods described in this document, as either a client or as a server or plurality of servers.

FIG. 5 is a block diagram of computing devices 500, 550 that may be used to implement the systems and methods described in this document, as either a client or as a server or plurality of servers. Computing device 500 is intended to represent various forms of digital computers, such as laptops, desktops, workstations, personal digital assistants, servers, blade servers, mainframes, and other appropriate computers. Computing device 550 is intended to represent various forms of mobile devices, such as personal digital assistants, cellular telephones, smartphones, and other similar computing devices. The components shown here, their connections and relationships, and their functions, are meant to be examples only, and are not meant to limit implementations described and/or claimed in this document.

Computing device 500 includes a processor 502, memory 504, a storage device 506, a high-speed interface 508 connecting to memory 504 and high-speed expansion ports 510, and a low speed interface 512 connecting to low speed bus 514 and storage device 506. Each of the components 502, 504, 506, 508, 510, and 512, are interconnected using various busses, and may be mounted on a common motherboard or in other manners as appropriate. The processor 502 can process instructions for execution within the computing device 500, including instructions stored in the memory 504 or on the storage device 506 to display graphical information for a GUI on an external input/output device, such as display 516 coupled to high-speed interface 508. In other implementations, multiple processors and/or multiple buses may be used, as appropriate, along with multiple memories and types of memory. Also, multiple computing devices 500 may be connected, with each device providing portions of the necessary operations (e.g., as a server bank, a group of blade servers, or a multi-processor system).

The memory 504 stores information within the computing device 500. In one implementation, the memory 504 is a volatile memory unit or units. In another implementation, the memory 504 is a non-volatile memory unit or units. The memory 504 may also be another form of computer-readable medium, such as a magnetic or optical disk.

The storage device 506 is capable of providing mass storage for the computing device 500. In one implementation, the storage device 506 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 504, the storage device 506, or memory on processor 502.

The high-speed controller 508 manages bandwidth-intensive operations for the computing device 500, while the low speed controller 512 manages lower bandwidth-intensive operations. Such allocation of functions is an example only. In one implementation, the high-speed controller 508 is coupled to memory 504, display 516 (e.g., through a graphics processor or accelerator), and to high-speed expansion ports 510, which may accept various expansion cards (not shown). In the implementation, low-speed controller 512 is coupled to storage device 506 and low-speed expansion port 514. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 500 may be implemented in a number of different forms, as shown in the figure. For example, it may be implemented as a standard server 520, or multiple times in a group of such servers. It may also be implemented as part of a rack server system 524. In addition, it may be implemented in a personal computer such as a laptop computer 522. Alternatively, components from computing device 500 may be combined with other components in a mobile device (not shown), such as device 550. Each of such devices may contain one or more of computing device 500, 550, and an entire system may be made up of multiple computing devices 500, 550 communicating with each other.

Computing device 550 includes a processor 552, memory 564, an input/output device such as a display 554, a communication interface 566, and a transceiver 568, among other components. The device 550 may also be provided with a storage device, such as a microdrive or other device, to provide additional storage. Each of the components 550, 552, 564, 554, 566, and 568, are interconnected using various buses, and several of the components may be mounted on a common motherboard or in other manners as appropriate.

The processor 552 can execute instructions within the computing device 550, including instructions stored in the memory 564. The processor may be implemented as a chipset of chips that include separate and multiple analog and digital processors. Additionally, the processor may be implemented using any of a number of architectures. For example, the processor may be a CISC (Complex Instruction Set Computers) processor, a RISC (Reduced Instruction Set Computer) processor, or a MISC (Minimal Instruction Set Computer) processor. The processor may provide, for example, for coordination of the other components of the device 550, such as control of user interfaces, applications run by device 550, and wireless communication by device 550.

Processor 552 may communicate with a user through control interface 558 and display interface 556 coupled to a display 554. The display 554 may be, for example, a TFT (Thin-Film-Transistor Liquid Crystal Display) display or an OLED (Organic Light Emitting Diode) display, or other appropriate display technology. The display interface 556 may comprise appropriate circuitry for driving the display 554 to present graphical and other information to a user. The control interface 558 may receive commands from a user and convert them for submission to the processor 552. In addition, an external interface 562 may be provide in communication with processor 552, so as to enable near area communication of device 550 with other devices. External interface 562 may provided, for example, for wired communication in some implementations, or for wireless communication in other implementations, and multiple interfaces may also be used.

The memory 564 stores information within the computing device 550. The memory 564 can be implemented as one or more of a computer-readable medium or media, a volatile memory unit or units, or a non-volatile memory unit or units. Expansion memory 574 may also be provided and connected to device 550 through expansion interface 572, which may include, for example, a SI MM (Single In Line Memory Module) card interface. Such expansion memory 574 may provide extra storage space for device 550, or may also store applications or other information for device 550. Specifically, expansion memory 574 may include instructions to carry out or supplement the processes described above, and may include secure information also. Thus, for example, expansion memory 574 may be provide as a security module for device 550, and may be programmed with instructions that permit secure use of device 550. In addition, secure applications may be provided via the SI MM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 564, expansion memory 574, or memory on processor 552 that may be received, for example, over transceiver 568 or external interface 562.

Device 550 may communicate wirelessly through communication interface 566, which may include digital signal processing circuitry where necessary. Communication interface 566 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 568. In addition, short-range communication may occur, such as using a Bluetooth, WiFi, or other such transceiver (not shown). In addition, GPS (Global Positioning System) receiver module 570 may provide additional navigation- and location-related wireless data to device 550, which may be used as appropriate by applications running on device 550.

Device 550 may also communicate audibly using audio codec 560, which may receive spoken information from a user and convert it to usable digital information. Audio codec 560 may likewise generate audible sound for a user, such as through a speaker, e.g., in a handset of device 550. Such sound may include sound from voice telephone calls, may include recorded sound (e.g., voice messages, music files, etc.) and may also include sound generated by applications operating on device 550.

The computing device 550 may be implemented in a number of different forms, as shown in the figure. For example, it may be implemented as a cellular telephone 580. It may also be implemented as part of a smartphone 582, personal digital assistant, or other similar mobile device.

Additionally computing device 500 or 550 can include Universal Serial Bus (USB) flash drives. The USB flash drives may store operating systems and other applications. The USB flash drives can include input/output components, such as a wireless transmitter or USB connector that may be inserted into a USB port of another computing device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), peer-to-peer networks (having ad-hoc or static members), grid computing infrastructures, and the Internet.

The computing system can include clients and servers. A client and server are generally remote from each other and typically interact through a communication network. The relationship of client and server arises by virtue of computer programs running on the respective computers and having a client-server relationship to each other.

Although a few implementations have been described in detail above, other modifications are possible. Moreover, other mechanisms for performing the systems and methods described in this document may be used. In addition, the logic flows depicted in the figures do not require the particular order shown, or sequential order, to achieve desirable results. Other steps may be provided, or steps may be eliminated, from the described flows, and other components may be added to, or removed from, the described systems. Accordingly, other implementations are within the scope of the following claims.

What is claimed is:

1. A computer-implemented method to modify usage of display device pixels, the method comprising:

monitoring, by a computing system, usage of a plurality of pixels of a display device;

determining, by the computing system based on analysis of the usage of the plurality of pixels, a target usage level;

identifying, by the computing system, that a first usage level of a first pixel of the plurality of pixels does not satisfy the target usage level;

configuring, in a screensaver image, a pixel that corresponds with the first pixel to have an intensity relative to other pixels of the screensaver image that, when presented on the display device, decreases a difference in usage between the first pixel and other pixels of the plurality of pixels, wherein the screensaver image includes a gradient extending outward from an area of pixels associated with a commonly displayed user interface feature, wherein the gradient is configured such that pixels near a location of the area of pixels are activated with more intensity and pixels further away from the location of the area of pixels are activated with less intensity;

subsequently selecting, by the computing system and in response to having identified that the first usage level of the first pixel does not satisfy the target usage level, an occasion at which to present the screensaver image on the display device; and communicating the screensaver image to the display device during the selected occasion.

2. The computer-implemented method of claim 1, wherein the display device comprises an organic light-emitting diode display device.

3. The computer-implemented method of claim 1, wherein monitoring the usage of the plurality of pixels of the display device includes monitoring an activated intensity of each pixel in the plurality of pixels at each of a plurality of times.

4. The computer-implemented method of claim 1, wherein determining the target usage level includes selecting multiple pixels from the plurality of pixels that have greatest usage levels among the plurality of pixels and using the usage levels for the multiple pixels that have the greatest usage levels to determine the target usage level.

5. The computer-implemented method of claim 1, wherein determining the target usage level includes selecting multiple pixels in proximity to the first pixel and using the usage levels for the multiple pixels in proximity to the first pixel to determine the target usage level.

6. The computer-implemented method of claim 1, wherein monitoring the usage of the plurality of pixels of the display device includes reducing, by the computing system, a common level of usage from all pixels in the plurality of pixels responsive to determining that all pixels in the plurality of pixels have at least the common level of usage.

7. The computer-implemented method of claim 1, wherein selecting the occasion at which to present the screensaver image includes identifying that a device in which the display device is housed has connected with an external power source.

8. The computer-implemented method of claim 1, wherein selecting the occasion at which to present the screensaver image includes identifying that the display device is in an off state.

9. The computer-implemented method of claim 1, wherein selecting the occasion at which to present the screensaver image includes identifying that a proximity sensor in a device in which the display device is housed has detected that an object is proximate the proximity sensor.

10. A computing system comprising:

one or more processors; and one or more computer-readable devices including instructions that, when executed by the one or more processors, cause the computing system to perform operations that comprise:

monitoring, by the computing system, usage of a plurality of pixels of a display device;

determining, by the computing system based on analysis of the usage of the plurality of pixels, a target usage level;

identifying, by the computing system, that a first usage level of a first pixel of the plurality of pixels does not satisfy the target usage level;

configuring, in a screensaver image, a pixel that corresponds with the first pixel to have an intensity relative to other pixels of the screensaver image that, when presented on the display device, decreases a difference in usage between the first pixel and other pixels of the plurality of pixels, wherein the screensaver image includes a gradient extending outward from an area of pixels associated with a commonly displayed user interface feature, wherein the gradient is configured such that pixels near a location of the area of pixels are activated with more intensity and pixels further away from the location of the area of pixels are activated with less intensity;

subsequently selecting, by the computing system and in response to having identified that the first usage level of the first pixel does not satisfy the target usage level, an occasion at which to present the screensaver image on the display device; and communicating the screensaver image to the display device during the selected occasion.

11. The computing system of claim 10, wherein the display device comprises an organic light-emitting diode display device.

12. The computing system of claim 10, wherein monitoring the usage of the plurality of pixels of the display device includes estimating the usage of the plurality of pixels based on:

(i) information that identifies a length at which each of multiple application programs had focus on the display device, and (ii) information that identifies intensity of the plurality of pixels in user interfaces of the multiple application programs.

13. The computing system of claim 10, wherein determining the target usage level includes selecting multiple pixels from the plurality of pixels that have greatest usage levels among the plurality of pixels and using the usage levels for the multiple pixels that have the greatest usage levels to determine the target usage level.

14. The computing system of claim 10, wherein determining the target usage level includes selecting multiple pixels in proximity to the first pixel and using the usage levels for the multiple pixels in proximity to the first pixel to determine the target usage level.

15. The computing system of claim 10, wherein monitoring the usage of the plurality of pixels of the display device includes reducing, by the computing system, a common level of usage from all pixels in the plurality of pixels responsive to determining that all pixels in the plurality of pixels have at least the common level of usage.

16. The computerized system of claim 10, wherein selecting the occasion at which to present the screensaver image includes identifying that a device in which the display device is housed has connected with an external power source.

17. The computing system of claim 10, wherein selecting the occasion at which to present the screensaver image includes identifying that the display device is in an off state.

18. The computing system of claim 10, wherein selecting the occasion at which to present the screensaver image includes identifying that a proximity sensor in a device in which the display device is housed has detected that an object is proximate the proximity sensor.

19. A non-transitory computer-readable medium having stored thereon instruction code executable by one or more processors of a computing system for causing the computing system to perform operations comprising:

monitoring, by the computing system, usage of a plurality of pixels of a display device;

determining, by the computing system based on analysis of the usage of the plurality of pixels, a target usage level;

identifying, by the computing system, that a first usage level of a first pixel of the plurality of pixels does not satisfy the target usage level;

configuring, in a screensaver image, a pixel that corresponds with the first pixel to have an intensity relative to other pixels of the screensaver image that, when presented on the display device, decreases a difference in usage between the first pixel and other pixels of the plurality of pixels, wherein the screensaver image includes a gradient extending outward from an area of pixels associated with a commonly displayed user interface feature, wherein the gradient is configured such that pixels near a location of the area of pixels are activated with more intensity and pixels further away from the location of the area of pixels are activated with less intensity;

subsequently selecting, by the computing system and in response to having identified that the first usage level of the first pixel does not satisfy the target usage level, an occasion at which to present the screensaver image on the display device; and communicating the screensaver image to the display device during the selected occasion.

20. The non-transitory computer-readable medium of claim 19, wherein monitoring the usage of the plurality of pixels of the display device includes monitoring an activated intensity of each pixel in the plurality of pixels at each of a plurality of times.

* * * * *